US005500183A

United States Patent [19]

Noordegraaf et al.

[11] Patent Number: 5,500,183

[45] Date of Patent: Mar. 19, 1996

[54] SN ALLOY BULLET THEREFOR

[75] Inventors: Jan Noordegraaf, Driebergen-Rijsenburg; Martinus A. Oud, Krimpen a/d IJssel; Harry Behm; Roelof de Rooy, both of Naarden, all of Netherlands

[73] Assignee: Billiton Witmetaal B.V., Netherlands

[21] Appl. No.: 344,096

[22] Filed: Nov. 23, 1994

[30] Foreign Application Priority Data

Nov. 26, 1993 [NL] Netherlands ..... 9302056

[51] Int. Cl.[6] ..... C22C 13/02; F42B 12/74; F42B 30/02

[52] U.S. Cl. ..... 420/557; 420/560; 420/561; 420/562; 102/501

[58] Field of Search ..... 420/557, 560, 420/561, 562, 580; 102/501, 517

[56] References Cited

U.S. PATENT DOCUMENTS

| | | | |
|---|---|---|---|
| 4,758,407 | 7/1988 | Ballentine et al. | 420/560 |
| 4,806,309 | 2/1989 | Tulman | 420/562 |
| 4,811,666 | 3/1989 | Lutfy | 102/501 |
| 4,881,465 | 11/1989 | Hooper et al. | 102/501 |
| 4,929,423 | 5/1990 | Tucker et al. | 420/561 |
| 5,223,347 | 6/1993 | Lhymn et al. | 428/614 |
| 5,279,787 | 1/1994 | Oltrogge | 419/38 |

FOREIGN PATENT DOCUMENTS

| | | | |
|---|---|---|---|
| 92/08097 | 5/1992 | WIPO | B42B 12/74 |
| 93/22089 | 11/1993 | WIPO | B22F 3/12 |

*Primary Examiner*—Sikyin Ip

*Attorney, Agent, or Firm*—Webb Ziesenheim Bruening Logsdon Orkin & Hanson

[57] ABSTRACT

The invention relates to a bullet based on an Sn alloy, wherein the Sn alloy comprises Cu, Sb, Bi and/or Zn as an alloying element, wherein the Sn alloy preferably contains 0.2–10% by weight Cu, preferably 0.2–6% by weight Cu, or 0.2–10% by weight Cu and 0.5–20% by weight Sb, preferably 0.2–5% by weight Cu and 0.5–10% by weight Sb, or 1–15% by weight Sb, preferably 1–10% by weight Sb, or 0.5–30% by weight Bi, preferably 5–20% by weight Bi, or 0.005–10% by weight Zn, preferably 0.01–1% by weight Zn. The invention further relates to the use of an Sn alloy for manufacturing a bullet.

20 Claims, No Drawings

SN ALLOY BULLET THEREFOR

BACKGROUND OF THE INVENTION

1. Field of the Invention

The present invention relates to a bullet and to the use of an Sn alloy therefor.

Understood by a bullet in this context are a solid projectile and shot particles for a small-shot cartridge.

2. Description of the Prior Art

At the present time lead alloys are used for bullets for sport and professional purposes. There is however increasing resistance to the use of such lead-containing bullets, since fired bullets which are not found produce in the environment ground pollution and accumulation of heavy metals in organisms due to leaching.

Another problem is that when the bullet is fired the weight of the bullet decreases. This weight decrease takes the form of lead-containing dust which is inhaled during firing. Another further problem is that lead fumes are inhaled during casting of the lead-containing bullets.

Up to the present there has been no good alternative to lead-containing bullets.

A problem of other types of alloys, for instance based on iron, is that such bullets are very hard, cause damage to the barrel and, when trapped in trees, can result in damage when such trees are sawn down.

SUMMARY OF THE INVENTION

The invention has for its object to provide a bullet substantially free of heavy metals such as lead and cadmium, whereof both the interior ballistics (barrel fouling/dust formation) and the exterior ballistics (predictable bullet flight and accuracy) are optimal, while in terms of dimensions the bullets can be properly calibrated and have a narrow tolerance.

After extensive alloy and firing tests a series of alloys has been developed which substantially fulfill the above described requirements and substantially do not have the above described drawbacks. It has been found that bullets based on a number of tin (Sn) alloys are satisfactory, wherein copper (Cu), antimony (Sb), bismuth (Bi) and/or zinc (Zn) can be used as alloying element for such an Sn alloy.

DETAILED DESCRIPTION OF THE PREFERRED EMBODIMENTS

With respect to the alloying element Cu, the Sn alloy can contain 0.2–10% by weight Cu, preferably 0.2–6% by weight Cu. Found to suffice well in practice were Sn alloys with 1–5% by weight Cu, such as Sn 3 Cu. Such Cu-containing Sn alloys were found to have optimum interior and exterior ballistics.

With regard to the alloying element Sb, both Sb-containing Sn alloys and Sb- and Cu-containing Sn alloys can be used.

In the case of the combined use of Cu and Sb the Sn alloy generally contains 0.2–10% by weight Cu and 0.5–20% by weight Sb, preferably 0.2–5% by weight Cu and 0.5–10% by weight Sb. It has been found in practice that the Sn alloy preferably contains 0.5–3% by weight Cu and 0.5–8% by weight Sb. Two very interesting alloys in practice are Sn 1.5 Cu 5.5 Sb and Sn 1 Cu 3 Sb. These alloys also have optimum interior and exterior ballistic properties.

If the Sn alloy contains only Sb as an alloying element, Sb is generally present in a quantity of 1–15% by weight Sb, preferably 1–10% by weight Sb. Found to be very interesting in practice is an Sn alloy containing 2.5–5% by weight Sb, such as Sn 5 Sb and Sn 2.5 Sb.

Another type of Sn alloy for such a bullet is based on the alloying element Bi which can be generally present in a quantity of 0.5–30% by weight Bi. Large quantities of Bi result however in an unacceptable increase in brittleness, whereby shattering of the bullet can occur. The Bi content therefore preferably amounts to 5–20% by weight. Alloys found interesting in practice are Sn alloys with 10–20% by weight Bi or 1–5% by weight Bi. Very interesting alloys are Sn 5 Bi, Sn 10 Bi, Sn 15 Bi and Sn 20 Bi.

Another Sn alloy for use in a bullet according to the invention is based on the alloying element Zn. Such alloys can be cast very well and are for this reason very suitable for self-casting of bullets, for instance for "bird-shoots". Such Sn alloys generally contain 0.005–10% by weight Zn, preferably 0.01–1% by weight Zn. Found interesting in practice were Sn alloys with 0.01–0.1% by weight Zn, such as Sn 0.04 Zn.

In order to further improve the ductility of the bullets according to the invention based on an Sn alloy, it is recommended to add to the Sn alloy Eutinal wherein Eutinal is a composition which is 90% by weight Zn, 5% by weight Al and 5% by weight Mg; Eutinal is also described in German Reference No. DE-A-3 135 847. For instance 0.01–1% by weight Eutinal can be added, whereby an optimum ductility is obtained.

The bullets on the basis of an Sn alloy generally contain very small quantities of other alloying elements, so-called trace elements. Each trace element may be present in a quantity of less than 0.1% by weight and in total the content of trace elements amounts to less than 0.5% by weight.

The bullets on the basis of an Sn alloy which contain Bi as alloying element are optimal for use in a Magnum 0.357 pistol wherein the bullet has outstanding interior and exterior ballistics.

The bullets on the basis of an Sn alloy with Cu as alloying element are highly suitable for applications on shooting ranges.

Finally, the bullets on the basis of an Sn alloy based on the alloying elements Cu and Sb are excellently suited for very many applications due to the maximal interior and exterior ballistic properties.

The Sn alloy can also be usefully applied in preparation of pellets or shot in small-shot cartridges (particle size 1–5 mm, preferably 2–3 mm diameter).

In the following example a large number of bullets on the basis of Sn alloys according to the invention were manufactured and firing tests were performed with such bullets using a Magnum 0.357.

The alloys used are stated in the table below, wherein the residual weight of the bullet is also stated as a percentage of the original bullet weight. All bullets were found to possess optimum interior and exterior ballistic properties in addition to a predictable bullet flight and accuracy. The bullets were moreover found to have a hardness in the order of at least 14 Brinell, whereby shattering in a bull's eye or a shot wild animal substantially does not occur. The maximum hardness often lay below 25 Brinell, whereby penetration of bullet-proof vests and internal damage to the pistol or rifle barrel substantially do not occur.

TABLE

| Bullet alloy based on Sn and residual weight ascertained after firing Alloy/Residual weight (% original weight) |
|---|
| Sn 3 Cu/96 |
| Sn 3 Cu 0.04 Eutinal/93 |
| Sn 1 Cu 3 Sb/96 |
| Sn 1.5 Cu 5.5 Sb/91 |
| Sn 2.5 Sb/93 |
| Sn 5 Sb/93 |
| Sn 2.5 Bi/79 |
| Sn 5 Bi/83 |
| Sn 10 Bi/87 |
| Sn 15 Bi/83 |
| Sn 20 Bi/86 |
| Sn 0.04 ZN/77 |

Of the alloys mentioned in the table a rough casting is made which is then calibrated to the calibre 0.357. The casting is greased and formed into a bullet by placing in a brass cartridge provided with a percussion cap and powder.

Using a Magnum 0.357 firing tests were performed with the bullets on the basis of the diverse Sn alloys according to the invention.

After each shot the fired bullet is weighed and the difference with its starting weight determined. The loss of alloy material can be seen from the residual weight as a percentage of the original bullet weight.

All bullets were found to possess a good flight and accuracy and good to outstanding interior and exterior ballistic properties.

The alloy Sn 0.75 Cu 0.25 Bi 0.04 Eutinal provides a finer bullet or small-shot structure whereby manufacture thereof is optimal.

We claim:

1. A bullet for use as a projectile, said bullet formed of a tin alloy, said tin alloy consisting essentially of:

0.2–10% by weight copper;

no greater than 20% by weight antimony;

no greater than 1% by weight Eutinal, wherein said Eutinal is 90% by weight zinc, 5% by weight magnesium, and 5% by weight aluminum;

inevitable impurities; and the balance tin.

2. The bullet as claimed in claim 1 wherein said tin alloy comprises 0.2–6% by weight copper.

3. The bullet as claimed in claim 2 wherein said tin alloy comprises 3% by weight copper.

4. The bullet as claimed in claim 1 wherein said tin alloy comprises 0.5–20% by weight antimony.

5. The bullet as claimed in claim 4 wherein said tin alloy comprises 0.2–5% by weight copper and 0.5–10% by weight antimony.

6. The bullet as claimed in claim 5 wherein said tin alloy comprises 0.5–3% by weight copper and 0.5–8% by weight antimony.

7. A bullet for use as a projectile, said bullet formed of a tin alloy, said tin alloy consisting essentially of:

1–15% by weight antimony;

no greater than 1% by weight Eutinal, wherein said Eutinal is 90% by weight zinc, 5% by weight magnesium, and 5% by weight aluminum;

inevitable impurities; and the balance tin.

8. The bullet as claimed in claim 7 wherein, in total, the content of said inevitable impurities is less than or equal to 0.5% by weight, and said antimony is 1–10% by weight.

9. The bullet as claimed in claim 8 wherein said antimony is within 2.5–5% by weight.

10. The bullet as claimed in claim 7 wherein said antimony is 2.5–5% by weight.

11. A bullet for use as a projectile, said bullet formed of a tin alloy, said tin alloy consisting essentially of:

0.5–30% by weight bismuth;

no greater than 1% by weight Eutinal, wherein said Eutinal is 90% by weight zinc, 5% by weight magnesium, and 5% by weight aluminum;

inevitable impurities; and the balance tin.

12. The bullet as claimed in claim 11 wherein said bismuth is 10–20% by weight.

13. The bullet as claimed in claim 11 wherein said trace elements are less than or equal to 0.5% by weight, and said bismuth is 5–20% by weight.

14. The bullet as claimed in claim 13 wherein said bismuth is 10–20% by weight.

15. The bullet as claimed in claim 11 wherein said bismuth is 1–5% by weight.

16. The bullet as claimed in claim 11 wherein said bismuth is 1–5% by weight and, in total, said inevitable impurities elements are less than or equal to 0.5% by weight.

17. A bullet for use as a projectile, said bullet formed of a tin alloy, said tin alloy consisting essentially of:

0.005–10% by weight zinc;

no greater than 1% by weight Eutinal, wherein said Eutinal is 90% by weight zinc, 5% by weight magnesium, and 5% by weight aluminum;

inevitable impurities; and the balance tin.

18. The bullet as claimed in claim 17 wherein said zinc is 0.01–1% by weight, and said inevitable impurities are less than or equal to 0.5% by weight.

19. The bullet as claimed in claim 18 wherein said zinc is 0.01–0.1% by weight.

20. The bullet as claimed in claim 17 wherein said zinc is 0.01–0.1% by weight.

* * * * *

UNITED STATES PATENT AND TRADEMARK OFFICE

CERTIFICATE OF CORRECTION

PATENT NO. : 5,500,183

DATED : March 19, 1996

INVENTOR(S) : Jan Noordegraaf, Martinus A. Oud, Harry Behm and Roelof de Rooy

It is certified that error appears in the above-indentified patent and that said Letters Patent is hereby corrected as shown below:

Title page and Column 1 Line 2 delete "THEREFOR".

Column 1 Line 45 "element" should read --elements--.

Column 2 Line 39 after "as" insert --an--.

Column 2 Line 39 "0.357" should read --.357--.

Column 2 Line 42 after "as" insert --an--.

Column 2 Line 56 "0.357." should read --.357.--.

Column 2 Line 65 "lay" should read --lies--.

Column 3 Line 15 "ZN/77" should read --Zn/77--.

Column 3 Line 20 after "placing" insert --it--.

Column 3 Line 22 "0.357" should read --.357--.

UNITED STATES PATENT AND TRADEMARK OFFICE

CERTIFICATE OF CORRECTION

PATENT NO. : 5,500,183

DATED : March 19, 1996

INVENTOR(S) : Jan Noordegraaf, Martinus A. Oud, Harry Behm and Roelof de Rooy

It is certified that error appears in the above-indentified patent and that said Letters Patent is hereby corrected as shown below:

Claim 13 Lines 30-31 Column 4 delete "trace elements" and insert --inevitable impurities--.

Claim 16 Lines 38-39 Column 4 "inevitable impurities elements" should read --inevitable impurities--.

Signed and Sealed this

Eighteenth Day of June, 1996

Bruce Lehman

*Attest:*

BRUCE LEHMAN

*Attesting Officer*

*Commissioner of Patents and Trademarks*